US008336758B2

(12) United States Patent
Scheu

(10) Patent No.: US 8,336,758 B2
(45) Date of Patent: Dec. 25, 2012

(54) POURING ELEMENT FOR A PACKAGE FOR HOLDING FLOWABLE OR POURABLE PRODUCTS AND METHOD OF PRODUCING SUCH A PACKAGE

(75) Inventor: Volker Scheu, Wermelkirchen (DE)

(73) Assignee: SIG Technology AG (CH)

( * ) Notice: Subject to any disclaimer, the term of this patent is extended or adjusted under 35 U.S.C. 154(b) by 826 days.

(21) Appl. No.: 11/885,355

(22) PCT Filed: Feb. 21, 2006

(86) PCT No.: PCT/EP2006/060151

§ 371 (c)(1),
(2), (4) Date: Jun. 22, 2009

(87) PCT Pub. No.: WO2006/092369

PCT Pub. Date: Sep. 8, 2006

(65) Prior Publication Data

US 2009/0261154 A1 Oct. 22, 2009

(30) Foreign Application Priority Data

Mar. 4, 2005 (DE) ..... 10 2005 010 547

(51) Int. Cl.
*B65D 5/74* (2006.01)

(52) U.S. Cl. ..... 229/125.15; 220/288; 222/566; 222/575; 229/125.14

(58) Field of Classification Search ..... 229/125.04, 229/125.14, 125.15; 220/288; 222/462, 222/566, 572, 575
See application file for complete search history.

(56) References Cited

U.S. PATENT DOCUMENTS

| | | | | |
|---|---|---|---|---|
| D136,098 | S * | 8/1943 | Hartman, Sr. | D9/447 |
| 2,543,909 | A * | 3/1951 | Hatheway, Jr. | 222/479 |
| 3,690,524 | A * | 9/1972 | Haberhauer | 222/573 |
| 4,227,629 | A * | 10/1980 | Froyman | 222/566 |
| 4,909,434 | A | 3/1990 | Jones et al. | |

(Continued)

FOREIGN PATENT DOCUMENTS

DE 2 417 387 A 10/1974

(Continued)

OTHER PUBLICATIONS

International Search Report for corresponding PCT application No. PCT/EP2006/060151 dated Feb. 11, 2008.

(Continued)

*Primary Examiner* — Gary Elkins
(74) *Attorney, Agent, or Firm* — Wood, Phillips, Katz, Clark & Mortimer

(57) ABSTRACT

There is shown and described a pouring element for a package for holding flowable or pourable products, and particularly a cardboard/plastics composite package having a gabletop, said pouring element having a pouring passage, the pouring passage having passage cross-sections of substantially identical areas arranged perpendicularly to its centerline, the outer passage cross-sections of the pouring passage being a product inlet opening and a substantially circular product outlet opening and the product inlet opening having associated with it a flange for connection to the package. To enable improved pouring characteristics to be achieved without having to accept disproportionately large costs and complication in production, provision is made, in the form for application, for the product inlet opening to be of an elongated shape which is not symmetrical in rotation.

6 Claims, 3 Drawing Sheets

U.S. PATENT DOCUMENTS

| | | | | |
|---|---|---|---|---|
| 5,110,041 | A * | 5/1992 | Keeler | 229/125.15 |
| 5,314,088 | A | 5/1994 | Heuberger et al. | |
| 6,079,586 | A * | 6/2000 | Hanneman | 220/526 |
| 7,185,784 | B2 | 3/2007 | Connors, Jr. et al. | |
| 2002/0014502 | A1 | 2/2002 | Taylor | |
| 2002/0030092 | A1 * | 3/2002 | Rendina et al. | 229/125.15 |
| 2003/0209575 | A1 * | 11/2003 | Bremner et al. | 222/566 |
| 2004/0256410 | A1 * | 12/2004 | Last | 222/92 |
| 2005/0205618 | A1 * | 9/2005 | Mabee et al. | 222/541.9 |
| 2008/0140047 | A1 * | 6/2008 | Young | 604/408 |

FOREIGN PATENT DOCUMENTS

| | | | |
|---|---|---|---|
| DE | 40 26 562 | A1 | 2/1992 |
| EP | 1 088 770 | A1 | 4/2001 |
| GB | 2 267 896 | A | 12/1993 |
| WO | WO 03/030695 | A1 | 4/2003 |

OTHER PUBLICATIONS

English language translation of DE 2 417 387 A.

* cited by examiner

POURING ELEMENT FOR A PACKAGE FOR HOLDING FLOWABLE OR POURABLE PRODUCTS AND METHOD OF PRODUCING SUCH A PACKAGE

This application is a National Stage filing of International Application Ser. No. PCT/EP2006/060151 filed Feb. 21, 2006, which claims priority of German Patent Application Serial No. 10 2005 010 547.5 filed Mar. 4, 2005, the disclosures of which are incorporated herein by reference.

BACKGROUND OF THE INVENTION

The invention relates to a pouring element for a package for holding flowable or pourable products, and particularly a cardboard/plastics composite package having a gabletop, said pouring element having a pouring passage, the pouring passage having passage cross-sections of substantially identical areas arranged perpendicularly to its centreline, the outer passage cross-sections of the pouring passage being a product inlet opening and a substantially circular product outlet opening and the product outlet opening having associated with it a flange for connection to the package. The invention further relates to a method of applying a pouring element having a flange to a package, preferably a flat-gabletop package, for receiving flowable products, which package has an opening.

Pouring elements of the abovementioned kind are already known from practice and are cylindrical in form. Because of this cylindrical configuration, it is easy for a re-closable screwed closure or the like to be provided at one end of the pouring element. The opposite end of the pouring element has in this case a flange which projects outwards radially in an annular shape. The pouring element is connected to the interior of the pack with a fluid-tight seal by means of this flange. To ensure that there is a secure connection, it is necessary for a comparatively wide flange to be provided.

Pouring elements of this kind are provided in particular on gabletop packages. These also include composite flat-gabletop packages which have long been known and which are very often used for packing liquid foodstuffs such as milk, juice and the like. As a rule, composite flat-gabletop packages are cuboid in shape and have a folded top seam which extends across the top of the package and is fastened by its ends to two opposite side-faces of the package.

As well as this, there are also other types of gabletop packages. One type is likewise composed of a composite material and has a gabletop which, when the package is in an upright position, extends upwards and which has two gabletop portions (inclined gable panels) which are inclined towards one another and which are separated by the top seam.

Known from EP 1 088 770 A1 is a pouring element of the generic kind for a cardboard beverage package such as is usually employed for milk, juices, etc. The pouring element has in this case a pouring passage which tapers slightly but otherwise has substantially identical cross-sectional areas arranged perpendicularly to its centreline. The outer passage cross-sections in the pouring element form a product inlet opening and a substantially circular product outlet opening, the product inlet opening having associated with it a flange for connection to the package.

DE 24 17 387 A1 on the other hand discloses a pouring device for a container which is assembled from two half-shells, the pouring device being inserted between the half-shells, which are in the form of sheet-metal or plate bodies, and being fastened thereto. For this purpose, the pouring device has, as well as an opening neck of cylindrical cross-section, an attaching member of boot-shaped cross-section at the container end, the free cross-section of the opening neck being far smaller than the free cross-section of the attaching member for the through-flow of flowable or pourable product. The pouring properties of the known pouring device are limited for this reason.

Also known, from U.S. Pat. No. 4,909,434, is a pouring element of cylindrical cross-section which has, at its package end, two flanges, thus enabling the pouring element to be sealed both to the inside and the outside of the package.

The lid for a drinking cup for children which is known from WO 03/030695 A1 comprises a pouring element which is produced in one piece with the lid. The free cross-sections of the passage through the pouring element taper from the product inlet opening to the product outlet opening, which latter is present simply in the form of a plurality of small holes. This is intended to stop product from escaping when there is not a reduced pressure applied by sucking on the pouring element.

A pouring element for a folding box made of cardboard having an inner bag arranged therein is described in, for example, DE 4 026 562 A1. The pouring element is welded to the inner bag, which in turn is bonded to the package from inside. The pouring passage in the known pouring element tapers in this case from the product inlet opening to the product outlet opening.

It is a disadvantage of the pouring element of the generic kind that, with a given right-angled portion of the gabletop, the maximum diameter of the pouring passage is fixed by the length of the shorter side of the gabletop portion and of the minimum width required for the flange. Hence, only relatively narrow pouring passages can be produced, in which the pouring speed is reduced and pouring is made more difficult. This is particularly true when flat-gabletop packages are used, because gabletop portions arranged at a slope have a larger area for the application of the pouring elements.

It should be pointed out in this connection that it is true, particularly with flat-gabletop composite packages, that the gabletop portion, and hence the permitted diameter, can be enlarged by moving the top seam to one side of the main body. However there is a price that has to be paid for this, which is a considerable increase in the complicatedness of production when the package itself is being produced. The fact is that, basically, the dimensions of a gabletop portion are hardly a matter of free choice but are substantially fixed by requirements relating to capacity, stability and stackability. What is more, a pouring element also has to be capable of being produced without any problems and at low cost. This is an additional way in which the opportunities for configuring the pouring elements are limited.

SUMMARY OF THE INVENTION

It is therefore an object of the present invention to design and refine a pouring element and a method of applying a pouring element to a package in such a way that improved pouring characteristics can be achieved without having to accept disproportionately large costs or complication in manufacture.

This object is achieved, in the case of a pouring element of the kind specified in the opening paragraph and described in detail above, by virtue of the fact that, in the form for application, the product inlet opening is of an elongated shape which is not symmetrical in rotation.

The invention makes it possible, with a given package, for the pouring element to be provided with a pouring passage which has a cross-sectional area for the outflow of product from the package which is far larger than is the case in the prior art. In the final analysis, the product is thus able to flow out of the package more easily and more quickly. If the pouring element is provided in a rectangular gabletop portion, the diameter of the product outlet opening can readily correspond to the length of the shorter sides of the gabletop portion without the product inlet opening having to be of an appreciably smaller cross-sectional area than the product outlet opening. It is even possible for the diameter of the product outlet opening to be larger than the length of the shorter sides of the gabletop portion if an overhang of the product outlet opening over the top seam is produced. In the end, the fact is that, because of the elongated configuration, which is not symmetrical in rotation, of the product inlet opening, the area of the corresponding gabletop portion which is available for the pouring element can be used to far better effect than is the case with pouring elements in the prior art.

What is meant by the form for application in the present case is the form of the pouring element in which the said pouring element is connected to the package. The form for application thus corresponds in essence to the form in which the pouring element is finally used.

In this connection, it goes without saying that the cross-sectional area of the product inlet opening may of course also be appreciably larger than the cross-sectional area of the product outlet opening. All that is essential is that the product outlet opening can be selected to be larger without the product inlet opening constituting a bottleneck and limiting the flow of product passing through the pouring passage. It also goes without saying that in pouring elements having product inlet openings larger than the product outlet openings, it is the product outlet openings which constitute the limiting bottleneck. Consequently it is possible, though not so preferred, for the product inlet opening to be made appreciably larger than the product outlet opening. In the end, as a result of the abandonment of pouring elements which are cylindrical throughout, there are, within a wide range, no limits on the size of the product outlet opening, which means that the product inlet and outlet openings may, as a rule, be made of the same size. The absolute size will depend on what is required or on what, with a given gabletop portion, is possible.

As a result of the abandonment of circular product inlet openings, the particular configuration of the latter can be optimally adjusted to the particular form of package or particular form of gabletop portion in respect of the cross-sectional area to be obtained, the ability to allow through-flow and simple production of the pouring element, it being conceivable for there to be product inlet openings of almost any desired shape.

With regard to the structural complication in the production and application of the pouring element, something that suggests itself is for the product inlet opening to be of a substantially oval or rectangular shape with rounded corners.

Depending on the shape selected for the configuration of the product inlet opening, it may be that the pouring element, whose passage has an elongated product inlet opening which is not symmetrical in rotation and a circular product outlet opening, cannot be produced in the form for application or can be produced therein only at considerable cost and complication. To deal with this problem, provision may be made for the pouring element to be capable of being changed from a production form to a form for application. In this way, the pouring element can be converted to a form for application after it has been produced. It is only in this form for application that the advantageous design features of the pouring element have an effect. The production form is characterised in this case in that the pouring element can be produced easily in this form. In this form in particular, a mould-part can readily be removed from the pouring passage after the production of the pouring element.

In a particularly preferred embodiment of the pouring element according to the invention, provision is made for the pouring passage to be substantially cylindrical in shape in the production form. This makes it possible for the pouring element to be produced by, for example, injection moulding or the like because a part of a mould or a tool which forms a negative of the pouring passage can then readily be removed from the pouring passage, which is then cylindrical, after the injection moulding or the like. It goes without saying that what are conceivable in this case are all approximately cylindrical, conical or comparable shapes for the pouring passage provided that the possibility of removal from the mould exists.

To enable the pouring element to be produced particularly easily in the production form and then to be changed to the form for application without any problems, the edge of the flange may, in the production form, rather than pointing radially outwards, be spaced away outwards in the direction of the product outlet opening in respect of two sides of the product inlet opening which are situated opposite one another. In other words, what this means is that the flange is bent or folded from, as it were, a plane perpendicular to the centreline towards the product outlet opening.

In this connection, it goes without saying that the flange may, basically, also be spaced away in the direction pointing away from the product outlet end, although a less compact pouring element is then obtained in the production form in this case. Furthermore, it is basically preferable if, in the production form, there are two further regions of the flange, with the flange being spaced away outwards in the opposite direction in these regions, i.e. in the direction of the product inlet end. In a preferred embodiment, this is almost necessarily so, the flange being moulded uniformly in the form for application and being of a constant thickness. However, there are, basically, certain freedoms of manoeuvre in this respect for the designer when deciding on the production form for the pouring element.

Regardless of the precise nature of the production form and the form for application, it is particularly preferable if, by bending of the flange, an at least approximately oval shape is automatically produced for the product inlet opening. What this means is that the production form and the form for application are positively linked to one another and it is preferably only these two forms which are stable, while the pouring element, when in a different form, attempts to change to one of the two forms mentioned.

To enable the pouring element to be connected to the package as such securely and with a fluid-tight seal, what suggests itself is for the flange to extend substantially in one plane in the form for application, which plane preferably extends perpendicularly to the centreline of the pouring passage. In this way, the flange and the portion of the package adjacent thereto may take the form of two parallel layers which cohere to one another with high cohesive forces.

From the point of view of good flow, it is particularly useful if the pouring element has, in the form for application, a portion at the product inlet end in which the passage cross-sections become more and more similar to a circle the farther they are arranged away from the product inlet opening. In other words, there is provided in the portion at the product inlet end a pouring passage which, preferably beginning at the product inlet opening, gradually approximates to a cylindrical passage in a direction of outflow. This transition from a non-circular, preferably oval, passage cross-section to a circular one, which transition is preferably smooth, makes it possible, in the final analysis, for there to be low pressure losses and an even through-flow.

To enable the pouring element to be configured to be recloseable in the form for application, something that suggests itself is for the portion at the product outlet end to be of a cylindrical form. Hence, the pouring passage does not, in the end, run to a circular product outlet opening for the whole of its lengthwise extent. In this way, the pouring element may readily be provided with a screw-cap or the like at the portion at the product outlet end.

Particularly advantageous use can be made of the area which is available on an gabletop portion for the pouring element if, in the form for application, the outer edge of the flange is spaced equally far away from the centreline as the edge of the product outlet opening, at least at two points which are situated opposite one another. In other words, what this means is that the distance between two points on the edge of the flange which are connected together by a straight line intersecting the centreline of the pouring element is the same size as the diameter of the product outlet opening. What can be achieved if the above-mentioned straight line is parallel to the shorter side of a rectangular gabletop portion is that the space available in this direction can be used both for the flange and for the product outlet opening. In the final analysis, the width of the product inlet opening and the flange, and the diameter of the product outlet opening, approximately correspond to the length of the shorter side of the gabletop portion.

To enable the pouring element to be applied easily, it may be preferable for the pouring passage, and preferably the entire pouring element, to be of an elastic form and to be able to be changed into a form in which the passage cross-sections are of an elongated shape which is not symmetrical in rotation. In the final analysis, this makes it possible for the pouring element, or at least its pouring passage, to be compressed and fed through a preformed opening from the inside of the package or the packaging material and for the flange then to be connected to the package. It is preferable in this case for the shape of the product inlet opening in the form for application and the shape of the opening to be approximately the same. It goes without saying that an elastic form of this kind for the pouring element may provide advantages both when the pouring element is produced in the production form and when the pouring element is produced directly in the form for application. In the first case it is also possible for the pouring element to be deformed elastically both in the production form and in the form for application depending on whether it is better for reshaping into the form for application to take place beforehand or afterwards. Both deformations may of course also be performed at the same time, which allows the speed of production to be increased.

The method of producing of such a package is characterised by the following steps: feeding of the package to a means of forming the pouring element and moulding on of the pouring element at the opening.

Hence, what is essential is that the pouring element is moulded on directly at the opening. Compared with the pouring element being produced and then applied to a package, it is possible, in the final analysis, for a step to be saved in the method. It is particularly useful if the moulding on of the pouring element takes place immediately before the filling operation. The means of forming the pouring element can thus be incorporated in, for example, the filling machine itself.

It is particularly useful if the moulding on takes place in such a way that the pouring element is connected to the pack at the same time, say during a cooling and solidification process such as occurs in injection moulding. A further step of the method can, in the final analysis, be saved in this way.

By contrast, the method of applying a pouring element which was specified in the opening paragraph is characterised in accordance with the invention by the following steps: forming of the pouring element in the production form in which it has a substantially cylindrical pouring passage, setting of at least one tool against the pouring element, bending of the flange, by the tool, into a form for application having a product inlet opening of an elongated shape which is not symmetrical in rotation, and connection of the flange to the package. It goes without saying in this connection that the flange and the package may be connected by bonding, welding or the like and the forming of the pouring element can be performed by injection moulding or the like. By means of the method according to the invention, it is possible for a pouring element having preferred pouring characteristics to be produced particularly easily.

Although basically any desired materials may be used for producing the pouring element, pouring elements made of plastics material, and preferably a thermoplastic plastics material such as, say, PE, PP, PVC, PET, etc., do however have preferred characteristics.

The invention will be explained in detail below by reference to drawings which each show merely one preferred embodiment of the pouring element according to the invention, the pack according to the invention and the method according to the invention

DETAILED DESCRIPTION OF THE DRAWINGS

Figure 1:
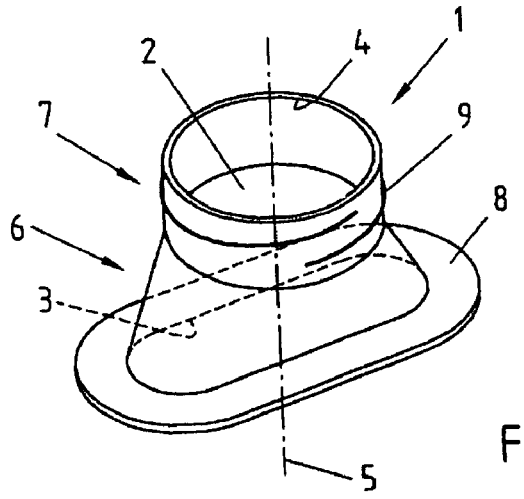
FIG. 1 is a perspective view of a pouring element according to the invention in the form for application.
Figure 2:
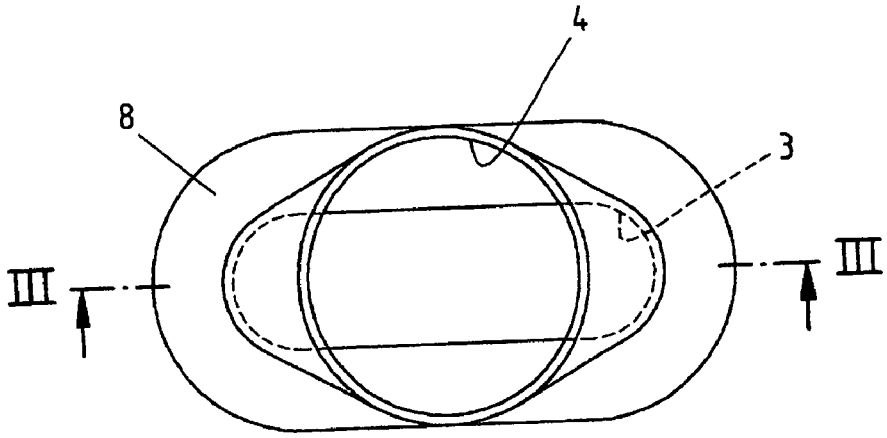
FIG. 2 is a plan view of the pouring element of FIG. 1.
Figure 3:
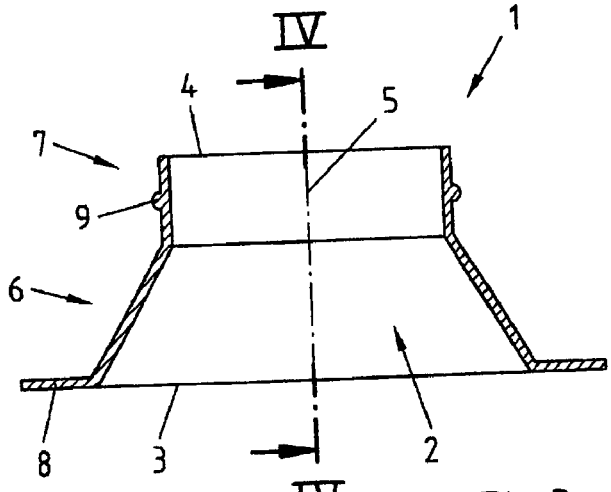
FIG. 3 is a section through the pouring element of FIG. 1 on plane III-III in FIG. 2.
Figure 4:
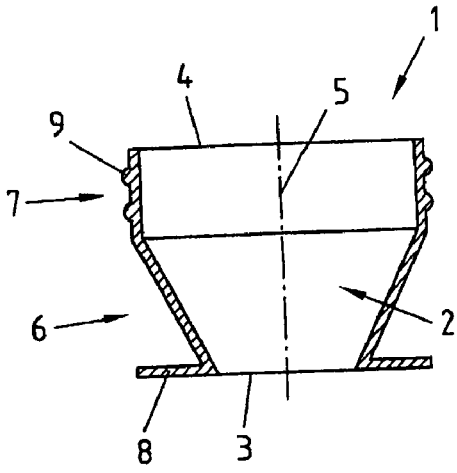
FIG. 4 is a section through the pouring element of FIG. 1 on plane IV-IV in FIG. 3.

FIGS. 1 to 4 show a pouring element 1 in the form for application (e.g., as being attached to a package 10). The pouring element 1 has a pouring passage 2 having a centreline 5 which extends in a straight line between a product inlet opening 3 and a product outlet opening 4. The pouring element 1 is so formed in this case that the product to be poured from a package first flows into the product inlet opening 3 and then flows through the pouring passage 2 before finally flowing out of the product outlet opening 4. Even though the form of pouring element 1 having a straight centreline 5 is preferred from the structural point of view, the centreline 5 may, nevertheless, extend in a curve. What may for example be achieved in this way is that the product inlet opening 3 and the product outlet opening 4 do not line up concentrically with one another, thus enabling the product outlet opening 4 to overhang, say, a top seam in a pack in the direction of an adjacent portion of the gabletop.

What is essential about the pouring element 1 which is shown is that the areas of the product inlet opening 3 and the product outlet opening 4 are preferably of equal sizes. Furthermore, the areas of all the cross-sections of the passage which extend perpendicularly to the centreline 5 are also identical to the area of the product inlet opening 3 or product outlet opening 4. This makes possible flow which is not subject to any widening or reduction of cross-section, which is particularly beneficial from the point of view of flow.

In the case of the pouring element 1 which is shown in FIG. 1, it can be seen that it is divided into a portion 6 at the product inlet end and a portion 7 at the product outlet end. The position in this case is that the product inlet opening 3 is substantially surrounded by a flange 8 which is spaced away outwards in a plane perpendicular to the centreline 5. This makes it possible for the face of the flange 8 remote from the product outlet opening 4 to be readily connected to the package, which means that the product will not escape accidentally or will not become contaminated from outside.

The position is also such that, in the portion 6 at the product inlet end, the pouring passage 2 tapers continuously in plane of section III-III and becomes continuously wider in plane of section IV-IV. What this leads to in the end is that the pouring passage 2 changes smoothly from an oval cross-sectional shape to a cylindrical portion 7 at the product outlet end. An outside thread 9 is also provided at this point, thus enabling a screw closure (not shown) to be screwed on easily. The final result of this is the ability of the pouring element 1 to be re-closed.

Figure 5:
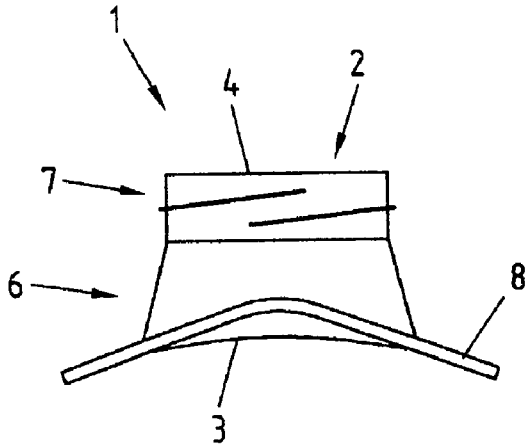
FIG. 5 is a side elevation as in FIG. 3 of the pouring element of FIG. 1, in the production form.
Figure 6:
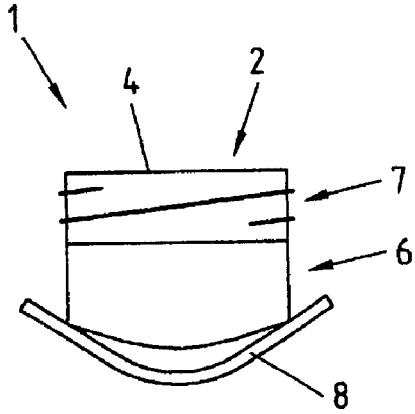
FIG. 6 is a side elevation as in FIG. 4 of the pouring element of FIG. 5.

As can be seen from FIGS. 5 and 6, the pouring passage 2 is of a substantially cylindrical shape in the production position (e.g., production shape or configuration such as a "moulded part" or pre-form). It is not necessary in this case for a perfectly cylindrical shape to be obtained. In the end, what is important is simply that the pouring passage 2 does not partly taper in and party widen along the centreline 5 in one direction. Otherwise, a mould-part which forms a negative of the pouring passage 1 cannot readily be removed from the pouring passage 2, which is preferably injection moulded, at the time of production. Although this may make the structure more costly and complicated, it is however possible for the mould to be produced in a multi-piece form. In this way, the individual parts may be put together, in a given sequence, into a mould which forms a negative of the pouring passage 2 and after production may be removed from the pouring passage 2. As an alternative or in addition, it is conceivable for the individual parts to be enlarged to form the mould and to be reduced in size again for removal from the pouring passage 2.

Figure 7:
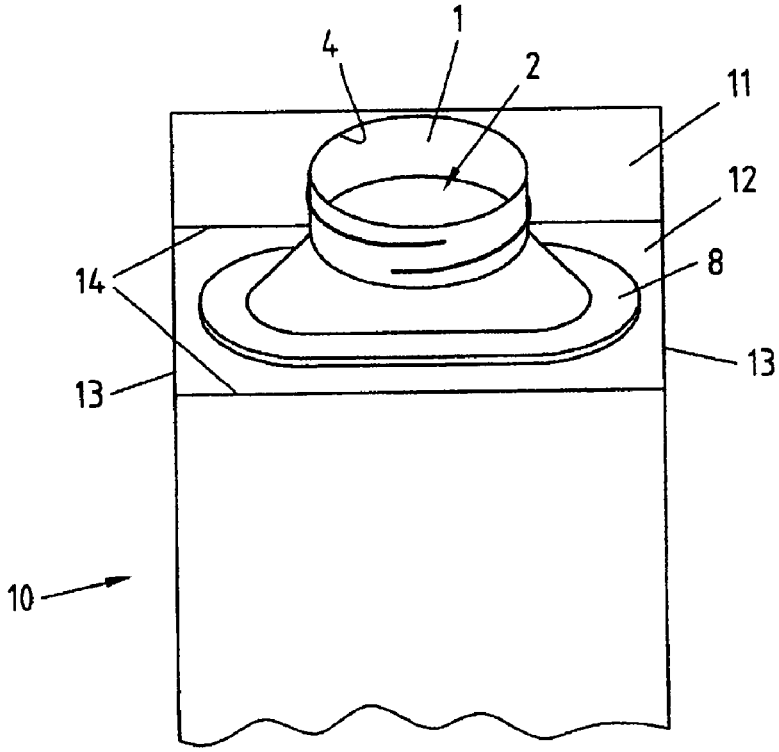
FIG. 7 is a perspective view of a gabletop of a pack according to the invention having the pouring element of FIG. 1.

Shown in FIG. 7 is the gabletop of a package 10 according to the invention having the pouring element 1 according to the invention shown in FIG. 1. The package 10 according to the invention is, in itself, a composite flat-gabletop pack. What is shown is, in the end, a flat gabletop having two gabletop portions arranged substantially parallel to one another. The gabletop portion 12 which is shown at the front has a pouring element 1 and an opening 16 which is shown in detail in FIG. 8. The shape and the area of the opening 16 are matched in this case to the product inlet opening 3.

What is essential is that the gabletop portion 12 is rectangular in form, having two shorter sides 13 transverse to a top seam 11 and two longer sides 14 parallel to the top seam 11. The situation in the preferred embodiment of the package 10 according to the invention is that a product outlet opening 4 is provided which is of an area which is not possible with packages from the prior art. The diameter of the product outlet opening 4 approximately corresponds to the length of the shorter sides 13. Basically, it would be possible for the product outlet opening 4 even to be appreciably larger, as a result of which it would project beyond the top seam 11. If that were the case, it would be preferable for the product outlet opening 4 not to project beyond the sides of the body of the package 10, in order, say, not to detract from the stackability of the pack 10.

The flange 8 too is of an extent parallel to the shorter side 13 which approximately corresponds to the length of the shorter sides 13. What is achieved in this way is that use is made of the space which is available in the direction of the shorter sides 13 and the pouring element 1 can be selected to be of a minimum extent in a direction parallel to the longer sides 14. This gives advantages from the point of view of flow, particularly with products containing lumpy constituents.

It goes without saying, particularly in the light of FIG. 7, that the flange 8 can, basically, also be arranged on the inside of the package 10, for which purpose it has however to be fed through the opening 16, preferably from the inside.

Figure 8A:
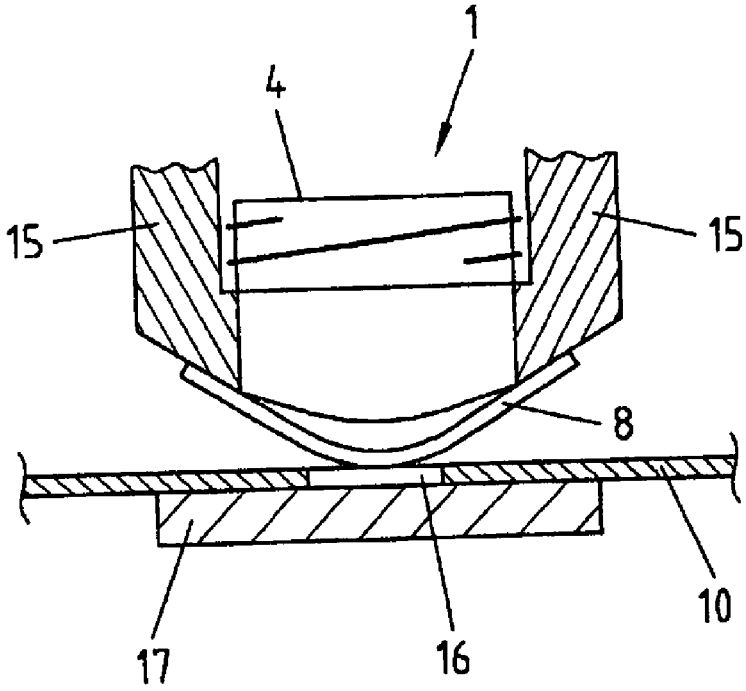
FIG. 8 is a schematic view of two steps of a method according to the invention.

FIG. 8A shows two steps in a preferred embodiment of the method according to the invention for applying the pouring element 1 on an opening 16. FIG. 8A is a schematic view of the setting of two tools 15 against the flange 8 from sides which are opposite to one another. The pouring element 1 is shown in this case from the same direction as in FIGS. 4 and 6. The flange 8 of the pouring element 1 was placed down on the opening 16 concerned in the package 10, which latter was resting in turn on a support 17, before the setting of the tools 15 against the package 10.

Basically however, the pouring element 1 could also come into contact with the package 10 only shortly before it was connected to the latter and could previously be pressed directly against the support 17. If the package 10 is sufficiently strong or if another kind of support is provided, the support 17 can even be dispensed with.

Figure 8B:
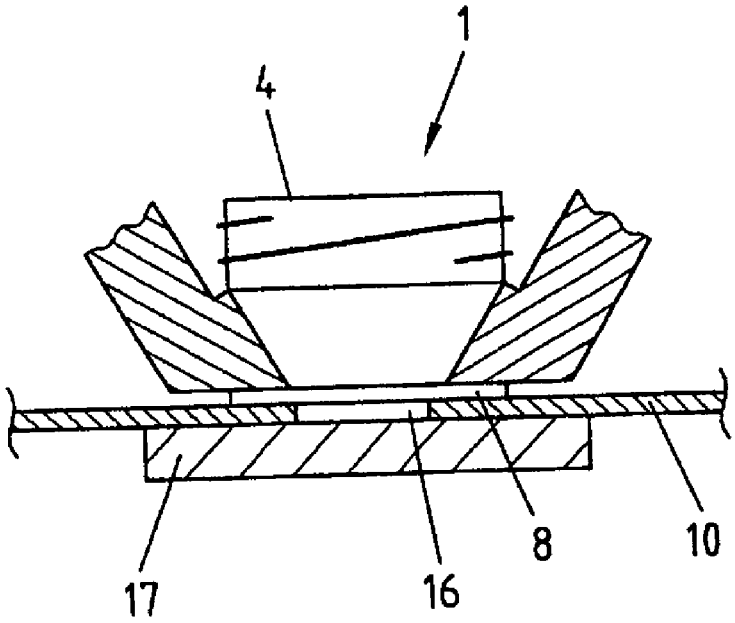

FIG. 8B shows the bending of the flange 8, and from it it can be seen that the tools 15 are tilted or are pivoted about an axis (not shown) to allow them to move to the end position, in which the pouring element 1 is now in its form for application. What is not shown in detail is that at their engaging ends the tools 15 are of a form suited to the form for application. It is true that this is not necessary but it may afford advantages for the course taken by the method. Also the number of tools 15 used is not fixed. Also, one tool 15 may, say, have a plurality of engaging elements for setting against the pouring element 1.

In this connection, it goes without saying that the pouring element 1 may also be connected to the package 10 by the side of the flange 8 remote from the product inlet opening 4. When this is the case, the pouring element 1 is fed through the opening 16 from the inside of the pack 10 with the product outlet opening 4 leading. The portion 7 at the product outlet end, and if required, the portion 6 at the product inlet end too, is elastic in this case and able to be changed to an oval shape to fit through the opening 16. It is conceivable in this connection for the elastic deformation of the pouring passage 2 to be caused by the tools 15 shown in FIGS. 8A and 8B, while they are for example reaching through the opening 16 and guiding the pouring passage 2 through the opening 16. Basically however, other tools which are not shown may also be used for this purpose. What is preferred however is for the pouring element 1 to be connected to the outside of the package 10 by the opposite face of the flange 8. This may enable the package 10 to be produced more quickly and under certain circumstances may result in a step of the method being saved. The bending of the flange 8 and the connection thereof to the package 10 may then, if required, also be performed substantially in one step of the method.

The invention claimed is:

1. Pouring element (1) in the form for application for a package (10) for holding flowable or pourable products, and which is especially suitable for a cardboard/plastics composite package having a gabletop, said pouring element (1) having a pouring passage (2), the pouring passage (2) having a constant cross-sectional flow area along the centerline (5) of the pouring passage (2), the passage cross-section of the pouring passage (2) at one end of said pouring passage (2) being a product inlet opening (3) and the passage cross-section of the pouring passage (2) at the other end of said pouring passage (2) being a substantially circular product outlet opening (4), and the product inlet opening (3) having associated with it a flange (8) for connection to the package (10), characterised in that the product inlet opening (3) is of an elongated shape which is not symmetrical in rotation.

2. Pouring element according to claim 1, characterised in that, in the form for application, the product inlet opening (3) is of a substantially oval or rectangular shape with rounded corners.

3. The pouring element according to claim 1, characterised in that, in the form for application, the flange (8) is arranged substantially in one plane.

4. The pouring element according to claim 1, characterised in that, in the form for application, the passage cross-section of the pouring passage (2) at said product inlet opening (3) is substantially oval, and in that said passage cross-section is increasingly circular with increasing distance from the product inlet opening (3).

5. The pouring element according to claim 4, characterised in that, in the form for application, a portion (7) at the product outlet opening is of a substantially cylindrical form.

6. The pouring element according to claim 1, characterised in that, in the form for application, the outer edge of the flange (8) is spaced approximately equally far away from the centreline (5) as the edge of the product outlet opening (4) at least at two points which are situated opposite one another.

* * * * *